United States Patent [19]

Willet et al.

[11] 4,069,964

[45] Jan. 24, 1978

[54] GUSSETED PINCH BOTTOM VALVED BAGS

[75] Inventors: George L. Willet, Gretna, La.; William D. Mushet, Wellsburg, W. Va.

[73] Assignee: Westvaco Corporation, New York, N.Y.

[21] Appl. No.: 772,329

[22] Filed: Feb. 25, 1977

[51] Int. Cl.[2] ..... B65D 31/14

[52] U.S. Cl. ..... 229/62.5

[58] Field of Search ..... 229/55, 62.5; 150/9; 93/35 R

[56] References Cited

U.S. PATENT DOCUMENTS

| | | | |
|---|---|---|---|
| 1,976,760 | 10/1934 | Baker | 229/62.5 |
| 2,294,846 | 9/1942 | Haungs | 229/62.5 |
| 2,895,387 | 7/1959 | Robinson et al. | 229/62.5 X |
| 3,472,130 | 10/1969 | Brockmuller | 229/62.5 X |
| 3,549,298 | 12/1970 | Brockmuller | 229/62.5 |
| 3,680,769 | 8/1972 | Siekierski | 229/62.5 X |
| 3,894,682 | 7/1975 | Harmsen | 229/62.5 |
| 3,990,626 | 11/1976 | Goodrich | 229/62.5 X |

FOREIGN PATENT DOCUMENTS

| | | | |
|---|---|---|---|
| 373,321 | 5/1932 | United Kingdom | 229/62.5 |
| 460,540 | 1/1937 | United Kingdom | 229/62.5 |

*Primary Examiner*—Stephen Marcus

[57] ABSTRACT

An improved multiwall, gusseted, stepped end pinch style bag is disclosed with provisions for forming a valve in one end thereof. The bag is prepared from a plurality of plies of flexible material such as kraft paper or the like and comprises at least one inner ply and one outer ply each of which is cut and scored to permit a valve area to be formed at one end when the gussets in that region are infolded while still retaining the conventional pinch style closure.

14 Claims, 15 Drawing Figures

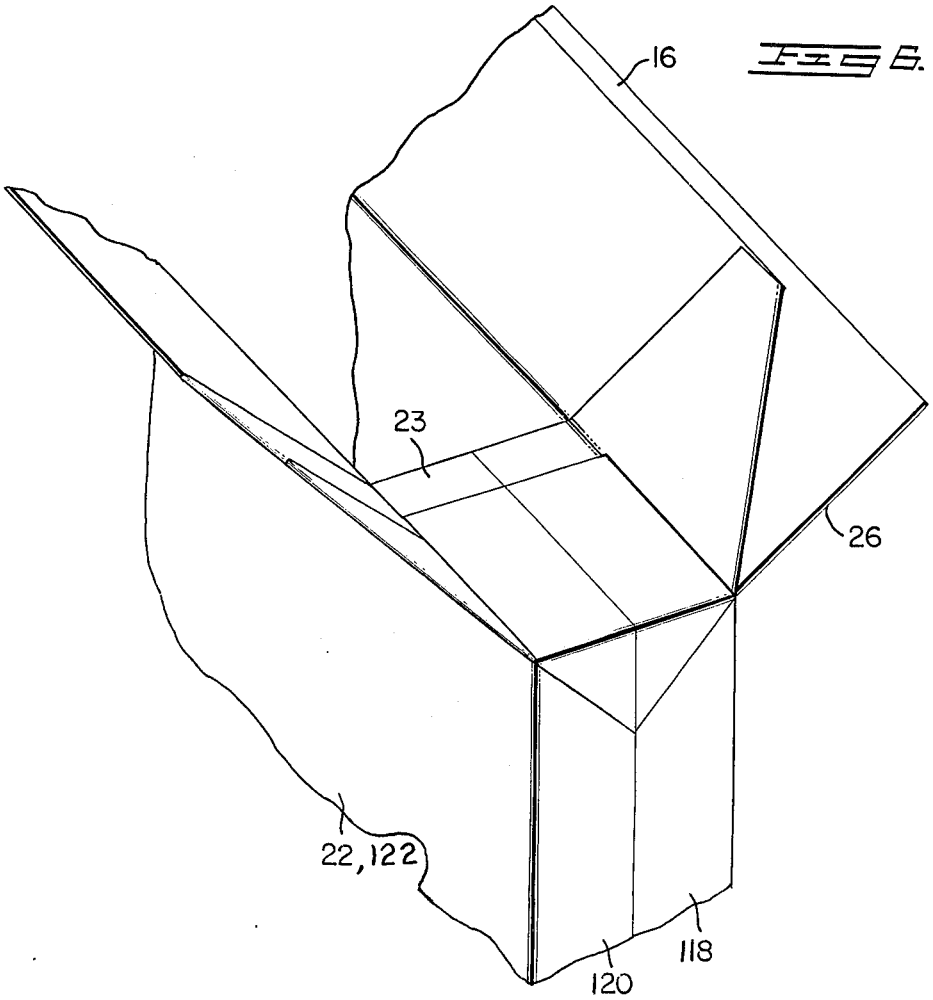
Fig 6.
Fig 7.
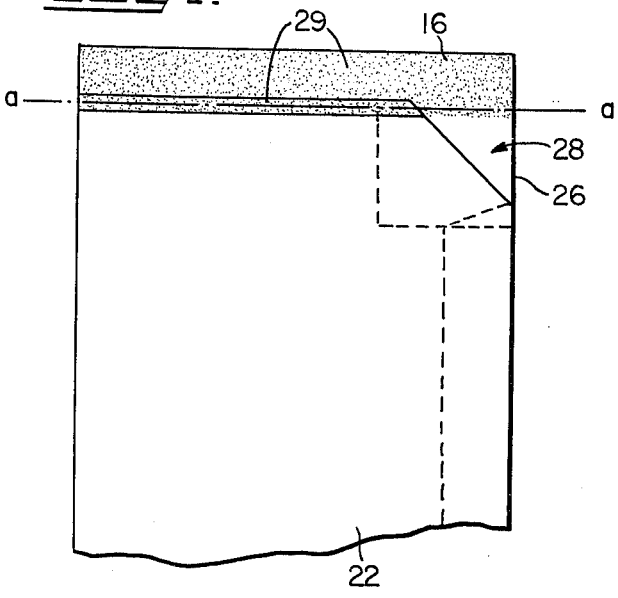
Fig 8.
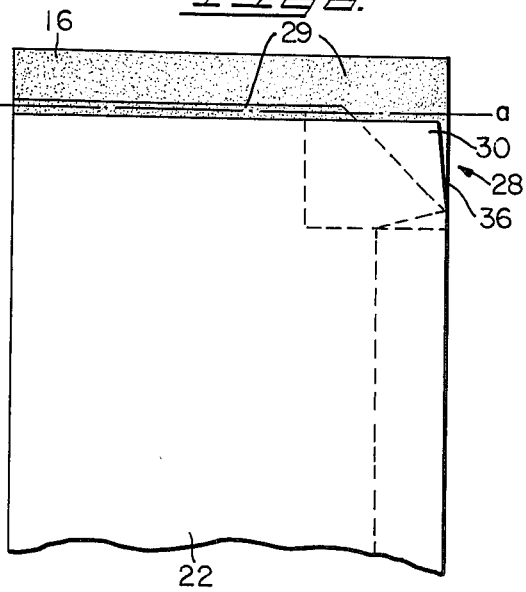

GUSSETED PINCH BOTTOM VALVED BAGS

BACKGROUND OF INVENTION

The present invention relates to multiwall, gusseted, stepped end bags and is particularly directed to improvements in bags as disclosed in U.S. Pat. No. 3,650,460 and other related patents. The type of bag disclosed herein is generally referred to in the industry as a pinch style bag because of its unique end closure.

Pinch style bags are well suited for packaging most materials but in particular, they are useful for packaging granular, free flowing products, products requiring a high degree of moisture protection and food grade products that require protection from infestation and contamination that may be caused by leakage and sifting of the packaged product. However, most prior art pinch style bags are of the open mouth type which can only be filled with open mouth filling equipment, and, such filling equipment tends to increase the aeration of fine powdery products which produces air release problems after the bags are sealed. Moreover, use of the open mouth pinch style bags of the prior art requires that each bag user have his own end sealing equipment.

To offset some of the problems inherent with the filling of fine powdery materials into an oen mouth pinch style bag, valved bags such as pasted end valved bags were adopted. These bags solved some of the filling problems such as decreased aeration of the product and the concurrent air release problems. However, the use of pasted end valved bags introduced severe leaking and sifting conditions that could not be tolerated, particularly when packaging food grade products. Accordingly, the bag of the present invention was developed to overcome the filling problems of prior open mouth pinch style bags and the leaking and sifting problems with prior art pasted end valved bags. Thus, the gusseted, stepped end, pinch style valved bag of the present invention with its integral valve and pinch style closure provides a filling versatility heretofore not available to pinch style bag users and a positive stepped end closure for improved resistance to leakage and sifting not previously achieved with pasted end valved bags.

DESCRIPTION OF PRIOR ART

As regards the pertinent prior art, pinch style bags are known as shown for example by the following prior U.S. Patent Nos.:

3,217,970 229-62)
3,687,356 (22955)
3,910,488 (229-55)
3,650,460 (229-55)
3,958,749 (22955)
3,990,626 (229-55)
3,966,115 229-55)

Similarly, valved bags are known as shown for example by the following prior U.S. Pat. Nos.:

1,976,760 (150-9)
2,045,585 (150-9)
2,761,612 (229-55)
1,977,298 (229-62)
2,539,799 (229-62)
2,895,387 (93-8)
3,990,628 (229-62.5)

On the other hand, none of the prior patents show a valved, pinch style bag prepared from kraft paper or the like. Accordingly, applicants herein are the first to discover a technique for making a valved, pinch style bag prepared from kraft paper or the like that is useful on filling equipment previously only used to fill valved bags with sewn, stitched, pasted or stapled ends. Moreover, applicants' bag construction with its pinch style closure achieves a utility greater than that known for prior valved bags and for prior pinch style bags.

SUMMARY OF INVENTION

In the bag of the present invention, a stepped end configuration is used which permits the formation of strong end closures in multiwall, gusseted bags by a simple folding and sealing operation. The strength of the bag results from the arrangement of the terminal edges of the different walls and gussets which form the tubular body of the bag. Accordingly, when adhesive is applied to the ends of the bag, the walls forming the gussets cooperate to hold the gussets firmly locked in place. The glued areas are unusually large as compared with pasted end bags which adds to the strength of the end seal. Moreover, as compared with other types of valved bags, the cost of the bag of the present invention is reduced, because consecutive bag blanks can be cut from a plurality of continuous webs of paper without wasting the paper of any web. In the past, one distinguishing feature between the manufacture of sewn end valved bags and conventional pinch style bags has been the fact that sewn end valved bags could not be made continuously without leaving waste paper at the end of the bag opposite the valve. This drawback is illustrated particularly in U.S. Pat. No. 2,895,387, cited hereinbefore. Thus it may be seen that the bag of the present invention provides all of the desirable features of the prior art sewn end valved bags, the prior art pasted end valved bags and the prior art pinch style bags.

DESCRIPTION OF DRAWING

FIG. 6 is a view similar to FIG. 5 showing a stage of the folding sequence for forming the valve of the bag of the present invention;

FIG. 7 is a partial side view of the valved end of a bag according to the present invention with adhesive applied and prior to the end sealing operation;

FIG. 8 is a view similar to FIG. 7 showing a bag according to the present invention prepared with the modification shown in FIG. 2(a);

DETAILED DESCRIPTION

The bag blanks of the present invention are cut from continuous webs of kraft paper or the like. The technique used is substantially the same as that disclosed in U.S. Pat. No. 3,650,460. In general, several plies of paper are used to make each bag. The number of plies may be varied to suit the particular end use of the bag with some of the plies being formed from specialty papers to give the bag unique properties such as water resistance and scuff resistance. However, the present invention is disclosed with the minimum number of plies required for a pinch style bag, namely two plies. Moreover, the preferred embodiment fully disclosed herein includes a valve notch in one of the plies for accomodating a sleeving operation. However, where desired, the sleeving could be omitted and the valve notch would then serve only as an extension of the valve material inside the bag. In addition, a bag construction is contemplated for the present invention wherein the valve notch would be eliminated entirely. Such a construction would represent an embodiment wherein the end seals of the bag would be enhanced, but less material would be available in the valve area for closing the valve after filling. For such a construction, an internal valve sleeve could be added if desired.

Figure 1:
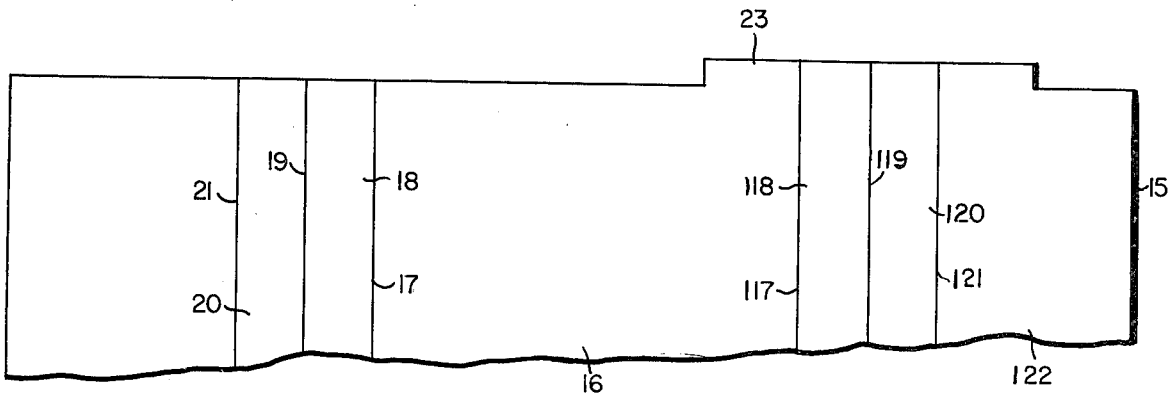
FIG. 1 is a plan view of a portion of a typical inner ply for the bag of the present invention.

FIG. 1 illustrates the upper end of a typical inner ply 15 for a bag in accordance with the present invention. As will be seen, the inner ply 15 contains a front panel 16 that is foldably attached along longitudinal edges 17, 117 to first gusset panels 18, 118. The first gusset panels 18, 118 are foldably attached along longitudinal edges 19, 119 to second gusset panels 20, 120. The second gusset panels 20, 120 are foldably attached along longitudinal edges 21, 121 to the rear walls 22, 122. The rear wall is formed from two sections, one attached to each of the second gusset panels 20, 120. Inner ply 15 further includes a valve notch 23 along the top edge that extends across the gusset panels 118 and 120 and 20, 120 at one side thereof for use in sleeving the valve portion of the bag. As will be appreciated from the description set forth hereinbefore, the bag blanks are prepared from multiple plies of paper or the like and are cut from continuous webs. Thus the valve notch 23 of one bag blank is cut from the opposite end of the next adjacent bag blank thereby achieving an essentially complete lack of waste paper between the bag blanks. Of course, where no valve notch is employed, the ends of the bag would be substantially identical. The height or length of the valve notch 23 is previously determined and depends on the size of the bag, the size of the valve opening desired, the type of valve employed and the type of sleeve used, if any. However, as shown in the drawings, the valve notch 23 is preferably stepped with respect to the top of outer ply 14 and the nominal top of inner ply 15 where the bag is to be sleeved. The width of valve notch 23 from side-to-side on ply 15 is preferably great enough to extend across both gusset panels 118 and 120 and for a distance along walls 16 and 122 which is slightly greater than the width of a gusset panel for a sleeved bag. In the preferred embodiment, the valve notch 23 is arranged symmetrically around longitudinal score line 119 but such orientation would not be absolutely required in all cases. Further, while inner ply 15 has been illustrated and described as a single ply of material, it could just as readily be formed from two or more plies cut and scored to the same or different dimensions where a different step pattern is desired.

Figure 2:
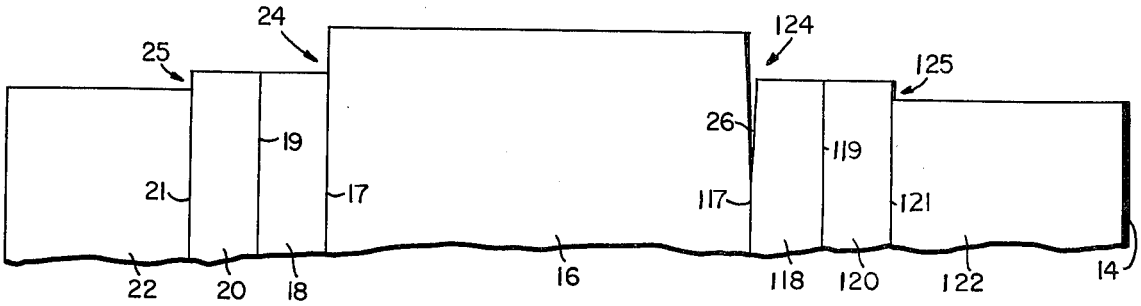
FIG. 2 is a plan view of a portion of a typical outer ply for the bag of the present invention.
Figure 2A:
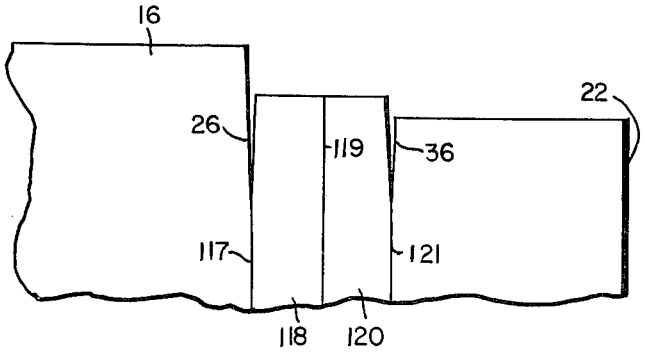
FIG. 2(a) is a partial plan view of an outer ply for the bag of the present invention showing a modified construction.

Meanwhile, FIG. 2 shows the upper end portion of a typical outer ply 14 for use in the bag of the present invention. As in the case of FIG. 1, the outer ply 14 includes front panel 16, gusset panels 18, 118 and 20, 120 and rear walls 22, 122 separated from one another by fold lines 17, 117, 19, 119 and 21, 121. The gusset panels 18 and 118 are offset longitudinally from front panel 16 to form steps 24, 124 at each side of the blank and the gusset panels 20, 120 are similarly offset to form the steps at 25, 125. It should be understood that while only one step pattern has been illustrated, the present invention is capable of being adapted to any desired step pattern as known in the art. Accordingly, outer ply 14 is formed similar to the plies used in connection with the manufacture of conventional or nonvalved pinch style bags except that a cut 26 is provided at one edge of panel 16 along longitudinal score line 117 for the purpose of assisting in the manufacture of the valve area. The length of cut 26 along front wall 16 is directly related to the size of the valve applied to the bag. Thus, in order to achieve a typical five inch valve, the cut 26 would be five inches long. Meanwhile, the amount of valve material inside the formed bag depends upon the length of the cut along the gusset panel plus the valve notch extension where a valve notch is added. As will be noted from a comparison of FIGS. 1 and 2, cut 26 is arranged in outer ply 14 along fold line 117 in the region which corresponds generally to the location of valve notch 23 on inner ply 15. Moreover, as shown more particularly in FIG. 2(a), a second cut 36 can be applied to the opposite side of gusset panels 118 and 120 where additional strength is required in the sealed end of the bag. The length of cut 36 along fold line 121 would terminate at substantially the same point as cut 26. Further, as in the case of the inner ply 15, outer ply 14 could readily be formed from two or more plies with the same or different stepped end patterns particularly as shown in the aforementioned prior art.

Figure 3:
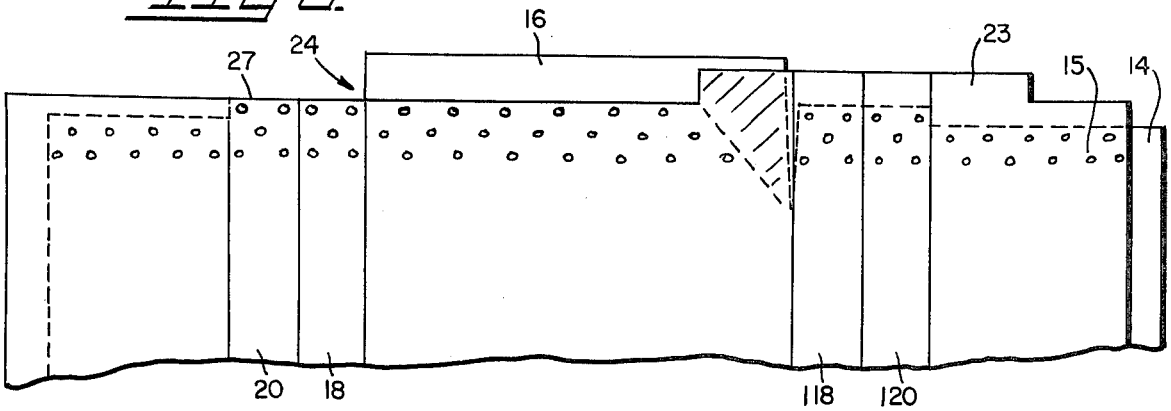
FIG. 3 is a partial plan view of the plies of FIGS. 1 and 2 superimposed over one another for preparing the bag blank of the present invention.

FIG. 3 shows the upper portion of a bag blank with the inner and outer plies 15, 14 superimposed over one another where they are adhered together. The adhesive pattern for the bag of the present invention is different from that of conventional pinch style bags. In the manufacture of conventional pinch style bags, adhesive is applied between the bag plies with a spot pasting operation across both ends of the bag from side-to-side. The depth of application of the adhesive along the bag plies generally extends inwardly about two inches from the free edges thereof although additional adhesive can be applied if desired. However, in order to manufacture the bag of the present invention, adhesive is omitted from between one or more of the outer bag plies and one or more of the inner bag plies in the region adjacent the cut at 26, or for the embodiment shown in FIG. 2(a), in the regions adjacent both cuts at 26 and 36. A typical adhesive pattern for the bag of the present invention is shown in FIG. 3 which illustrates a spot adhesive application except in the shaded region between the inner and outer plies on front walls 16. The absence of adhesive in this region permits the valve notch 23 and inner ply gussets to be folded inward from outer ply 14, as shown in FIG. 6, to form the valve, while leaving the full width of front wall 16 available for folding over rear wall 22, 122 when the end of the bag is sealed. It will be noted that the two plies are offset from one another side-to-side and arranged longitudinally so that the upper edge 27 of ply 15 is aligned with the first step 24 of ply 14. This configuration produces a bag blank wherein the height of front wall 16 on ply 14 is greater than the height of the valve notch 23 on ply 15. This is the preferred arrangement although not necessarily required in order to maintain the pinch style bag configuration on which the present invention is based. After the plies are arranged as shown in FIG. 3, the longitudinal marginal edges of the plies are folded over where the offset edges are adhered together to form the tubular body of the bag. After the tubed structures are formed, they are passed through a mechanical separating operation wherein the individual bag blanks are separated from one another.

Figure 4:
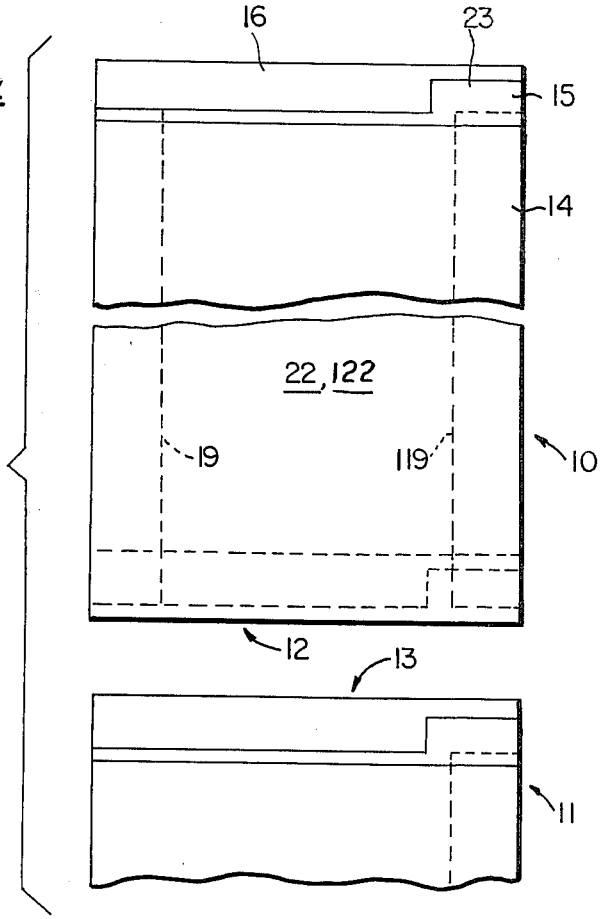
FIG. 4 is an exploded plan view showing a first bag blank separated from a second bag blank.

FIG. 4 illustrates a first bag blank 10 after separation from the next subsequent blank 11 with the gusset panels 18, 118 and 20, 120 at each side folded between the front wall 16 and rear wall 22, 122. As will be seen from a careful inspection of FIG. 4, the end 12 of bag blank 10 is the mirror image of the end 13 of bag blank 11. Thus as distinguished from conventional kraft paper pinch style bag constructions, the preferred bag construction of the present invention includes a valve notch at one end which can be sleeved.

Figure 5:
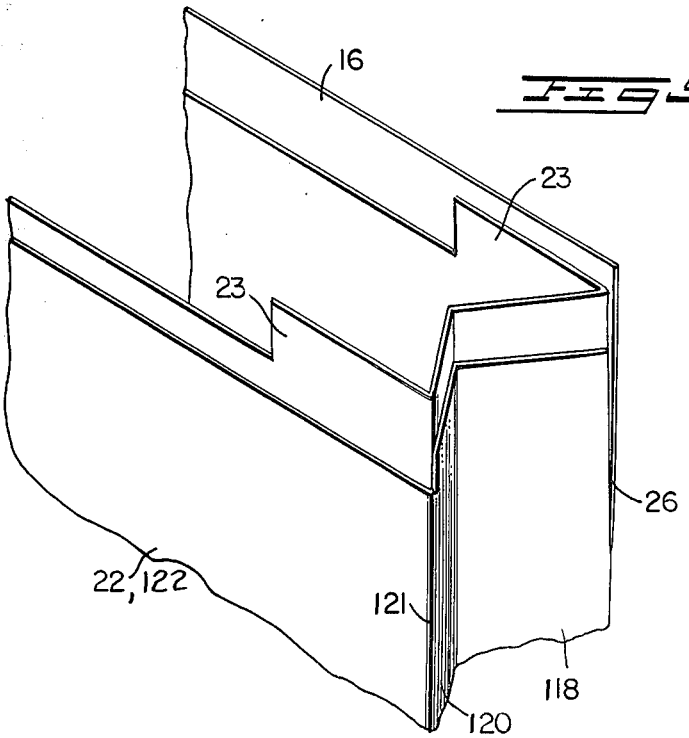
FIG. 5 is a partial perspective view showing an end of a bag blank according to the present invention opened and in condition for the valving operation.
Figure 9:
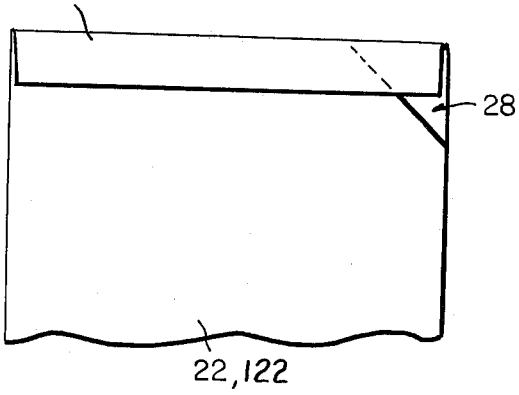
FIG. 9 shows the bag of FIG. 7 in the sealed condition.
Figure 10:
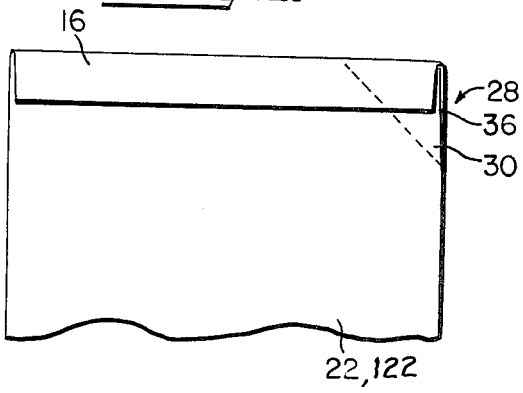
FIG. 10 shows the bag of FIG. 8 in the sealed condition.
Figure 11:
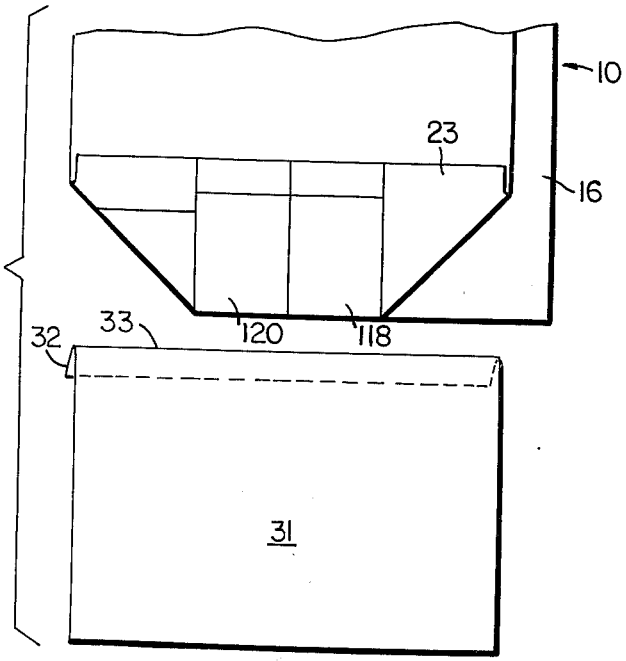
FIGS. 11–14 show a typical sleeving sequence for a bag according to the present invention.
Figure 12:
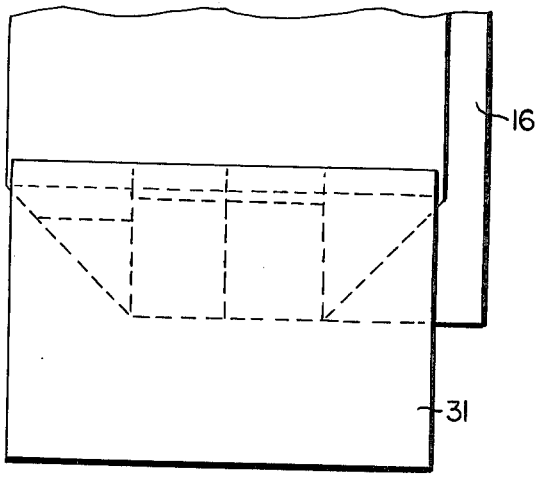
Figure 13:
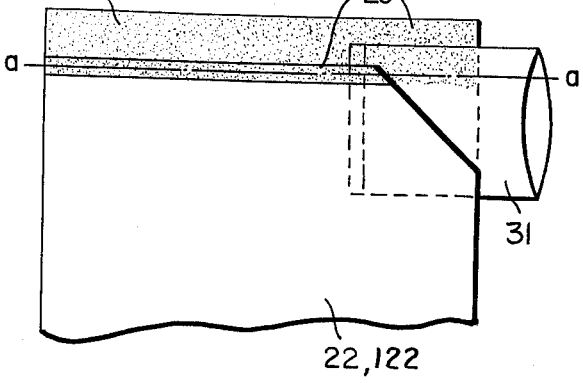
Figure 14:
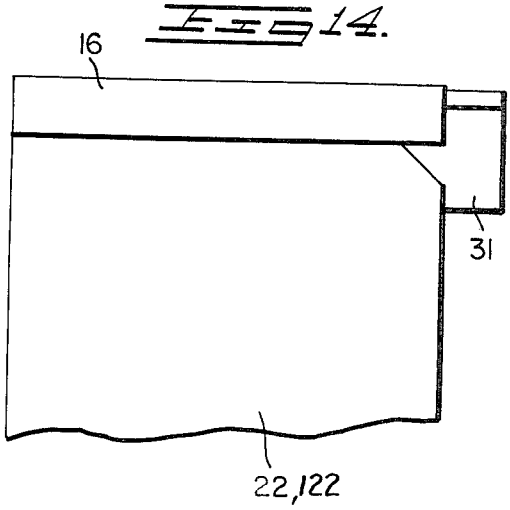

FIG. 5 shows the bag of the present invention in perspective with front and rear walls spread apart to open the gussets 118, 120. As in the case of the formation of valves in conventional (i.e., sewn or pasted end) gusseted bags, the gussets of the bag of the present invention are folded inside the bag to form the valve area particularly as shown in FIG. 6. In this regard reference is made to the disclosure in U.S. Pat. No. 1,976,760 (cited herein), wherein a method is disclosed for forming a valve in the end of a gusseted bag with stapled ends. It will be noted from a comparison of the latter patent with FIGS. 5 and 6 herein that the mechanical procedure for forming the valve area 28 of the present invention is substantially the same. However, because the bag construction of the present invention is limited to that of a pinch style bag, the identical procedure cannot be followed without some modification to the bag blank structure. For this purpose, it will be noted that a cut 26 between front wall 16 and gusset wall 118 is required in the bag blank of the present invention along with the previously mentioned omission of adhesive to insure that there will remain a portion of front wall 16 in the valve area 28 to overlap wall 22, 122 and seal the end of the bag. FIG. 7 illustrates a side view of the general configuration of a valved bag as prepared in accordance with the present invention and using the blank configuration shown in FIG. 3. FIG. 8 shows a similar view of the valved bag of the present invention prepared with a modified blank incorporating the ply configuration shown in FIG. 2(a). When adhesive 29 is applied to the exposed flap portion of panel 16 and the stepped end of wall 22, 122, and the end of the bag blank is folded over about the fold line *a–a*, the ends of the bags are sealed closed substantially as shown in FIGS. 9 and 10. FIG. 9 shows the closed end of the bag of the present invention with the valve at 28 available for insertion of a filling spout substantially as in the case of sewn, pasted or stapled end valved bags. FIG. 10 shows the modified bag of the present invention wherein with the application of a second cut at 36, an additional portion 30 of rear wall 22, 122 is made available for sealing the folded over part of front panel 16. The valve area 28 remains exposed in FIG. 10 substantially as in the case of FIG. 9, but the addition of panel 30 provides a more secure and stronger closure. Accordingly, it may be seen that the valved bags of the present invention particularly as shown in FIGS. 9 and 10 offer a superior construction to that of prior valved bags with sewn, stitched or stapled ends while still being useful on the filling equipment normally used with the prior art bags.

Where necessary or desired the valve of the bag of the present invention can also be sleeved. For this purpose a cufftype tuck in sleeve is preferred but other types of sleeves such as L-C sleeves may also be used. FIG. 11 shows the bag blank 10 in position and ready to accept a tuck in sleeve 31 in blank form. As shown, the fully assembled bag blank 10 is passed through a sleeving machine (or the sleeves can be assembled by hand) where the bag blank is spread open with gussets 118, 120 flattened and valve notch 23 is exposed for accepting the sleeve. The sleeve 31 is folded over about a score line 33 to provide a tuck in flap 32 and adhesive is preferably applied to the sleeve 31 and flap 32 in the area between the fold at 33. Subsequently, the sleeve 31 is inserted into the bag blank 10 where it is adhered to the valve notch 23 to form a structure substantially as shown in FIG. 12. When the sleeved blank comes out of the sleeving machine, the gussets 118, 120 once again become tucked between walls 16 and 22, 122 and the top of the bag is applied with adhesive 29 (FIG. 13) before being folded over about fold line *a–a* to complete the final bag structure as shown in FIG. 14.

It will be noted from a careful review of FIGS. 11–14 that when undeveloped tuck in sleeves 31 are applied to the bag blank of the present invention, the sleeve is placed on the blank such that the adhesive application 29 serves the dual purpose of closing the end of the bag and developing or completing the sleeve. Where other type sleeves are used the placement of the sleeve on the blank could be arranged differently.

Thus, while only a preferred embodiment of the present invention has been fully described and illustrated herein, it should be understood that various changes in the details, materials and arrangements of parts which have been disclosed, may be made by those skilled in the art within the principles and scope of the invention as expressed in the appended claims.

We claim:

1. A gusseted, valved multiwall pinch style bag having a tubed body formed from a plurality of plies of flexible sheet material, said plies comprising at least one inner ply and at least one outer ply each comprising a front wall, a pair of first gusset panels foldably connected to said front wall along a first pair of fold lines, a pair of second gusset panels foldably connected to said first gusset panels along a second pair of longitudinal fold lines and a rear wall foldably connected to said second gusset panels along a third pair of longitudinal fold lines, the terminal edges of the plies at each end of the tubed body being stepped with respect to one another to provide stepped end closures, the improvement comprising means associated with said bag for forming a valve in one end thereof characterized by:

a. at least one cut line in an outer ply of said tubed body located along a fold line between one of the walls of said bag and a gusset panel of said bag at one side of said tubed body; and, b. a uniformly applied spot adhesive application between said inner and outer plies except in the region adjacent to said cut line.

2. The bag of claim 1 wherein the length of said cut line along the wall of said bag is equal to the size of the valve opening in said bag.

3. The bag of claim 2 wherein an integral valve notch is included at one end of an inner ply of said tubed body in the region of the gusset panels at the valved end of said bag.

4. The bag of claim 3 wherein inclusion of the valve notch at one end of said inner ply creates a recess corresponding to said valve notch in the opposite end of said ply.

5. The bag of claim 4 wherein the valve notch has a width along said inner ply that is greater than the width of said gusset panels.

6. The bag of claim 5 wherein the valve notch is stepped with respect to the nominal height of the front and rear walls of said outer bag ply.

7. The bag of claim 6 wherein a sleeve member is adhered to the valve notch.

8. The bag of claim 2 wherein a second cut line of the same depth as said first cut line is applied to the outer ply of said tubed body along a fold line between another wall of said bag and a second gusset panel of said bag at one side of said tubed body.

9. The bag of claim 8 wherein an integral valve notch is included at one end of an inner ply of said tubed body in the region of the gusset panels at the valved end of said bag.

10. The bag of claim 9 wherein inclusion of the valve notch at one end of said inner ply creates a recess corresponding to said valve notch in the opposite end of said ply.

11. The bag of claim 10 wherein the valve notch has a width along said inner ply that is greater than the width of said gusset panels.

12. The bag of claim 11 wherein the valve notch is stepped with respect to the nominal height of the front and rear walls of said outer bag ply.

13. The bag of claim 12 wherein a sleeve member is adhered to the valve notch.

14. A gusseted, valved multiwall pinch style bag having a tubed body formed from a plurality of plies of flexible sheet material, said plies comprising at least one inner ply and at least one outer ply that are adhered to one another substantially throughout their entire width along the free edges thereof, each ply comprising a front wall, a pair of first gusset panels foldably connected to said front wall along a first pair of longitudinal fold lines, a pair of second gusset panels foldably connected to said first gusset panels along a second pair of longitudinal fold lines and a rear wall foldably connected to said second gusset panels along a third pair of longitudinal fold lines, the terminal edges of the plies at each end of the tubed body being stepped with respect to one another to provide stepped end closures, the improvement comprising means associated with said bag for forming a valve in one end thereof characterized by:

a. at least one cut line in an outer ply of said tubed body along a fold line between one of the walls of said bag and a gusset panel of said bag at one side of said bag; and, b. the absence of adhesive between said inner and outer plies in the region adjacent to said cut line which permits the gusset panels of both the inner and outer plies to be infolded to form a valve opening in said tubed body while leaving a flap portion of said outer ply available for closing the valved end of said bag.

* * * * *